United States Patent [19]

Ishino et al.

[11] Patent Number: 4,515,850

[45] Date of Patent: May 7, 1985

[54] COMPOSITE FERRITE TEXTILE

[75] Inventors: Ken Ishino; Yasuo Hashimoto; Kenichi Ichihara; Yoshikazu Narumiya, all of Tokyo, Japan

[73] Assignee: TDK Corporation, Tokyo, Japan

[21] Appl. No.: 529,992

[22] Filed: Sep. 7, 1983

[30] Foreign Application Priority Data

Sep. 13, 1982 [JP] Japan ..... 57-158218
Nov. 24, 1982 [JP] Japan ..... 57-204616

[51] Int. Cl.[3] ..... D03D 3/00

[52] U.S. Cl. ..... 428/225; 264/112; 427/434.2; 428/242; 428/263

[58] Field of Search ..... 428/224, 242, 225, 229, 428/260, 262, 263; 427/434.2; 264/112, 118

[56] References Cited

U.S. PATENT DOCUMENTS 900,653 10/1908 Book ..... 428/242
2,733,162 1/1956 Roseveare ..... 428/242
3,616,184 10/1971 Katagiri et al. ..... 428/242
4,442,152 4/1984 Kirk ..... 428/354

FOREIGN PATENT DOCUMENTS 11282 1/1977 Japan ..... 428/242

*Primary Examiner*—James J. Bell
*Attorney, Agent, or Firm*—Banner, Birch, McKie & Beckett

[57] ABSTRACT

A composite ferrite cloth having ferro-magnetic property weaved with composite ferrite textile has been found. The composite ferrite textile is the mixture of ferrite powder and the binder for coupling the same. The binder may be a high molecule compound like plastics, or glass with low melting point. The composite textile may be produced either by slicing a composite ferrite sheet attached on a plastics substrate, depositing composite ferrite paint around a core textile similar to the producing process of an electric wire, or just mixing ferrite powder with plastics or glass. The ferrite cloth which is weaved with composite ferrite textile is flexible and has many fields of application.

20 Claims, 9 Drawing Figures

COMPOSITE FERRITE TEXTILE

BACKGROUND OF THE INVENTION

The present invention relates to composite ferrite textile, which is used for ferro-magnetic material for electronic components, electromagnetic wave absorber, electromagnetic wave shielding means, core material of a transformer, and/or electronic components.

Conventionally, a sintered bulk ferrite body has been used for a core of a transformer, a core of a permanent magnet, electromagnetic wave absorber, and/or components of electronic devices. However, ferrite material has the disadvantages that it is easy broken, and it is difficult to manufacture complicated shapes. In order to solve the above problem, a composite ferrite like gum ferrite, which is the composite of ferrite powder and high-molecular compound like plastics has been used. The composite ferrite has the advantages that the structure is strong, and the manufacturing process for a complicated structure is easy. That composite ferrite is manufactured by the injection molding, extrusion, and/or compression molding.

However, the piror composite ferrite has still the disadvantage that the nature of the material is not enough for the easy manufacturing process as compared with the plastics material itself.

SUMMARY OF THE INVENTION

It is an object, therefore, of the present invention to overcome the disadvantages and limitations of prior magnetic material by providing a new and improved composite ferrite textile.

It is also an object of the present invention to provide a composite ferrite textile which is flexible enough to conform with any desired shape, and can be produced with an easy manufacturing process.

The above and other objects are attained by a composite ferrite textile which is the mixture of ferrite powder and binder for coupling the ferrite powder with so that volume ratio of ferrite powder to the mixture is in the range between 0.2 and 0.8.

Preferably, the textile is woven into cloth.

BRIEF DESCRIPTION OF THE DRAWINGS

The foregoing and other objects, features, and attendant advantages of the present invention will be appreciated as the same become better understood by means of the following description and accompanying drawings wherein.

DESCRIPTION OF THE PREFERRED EMBODIMENTS

Figure 1:
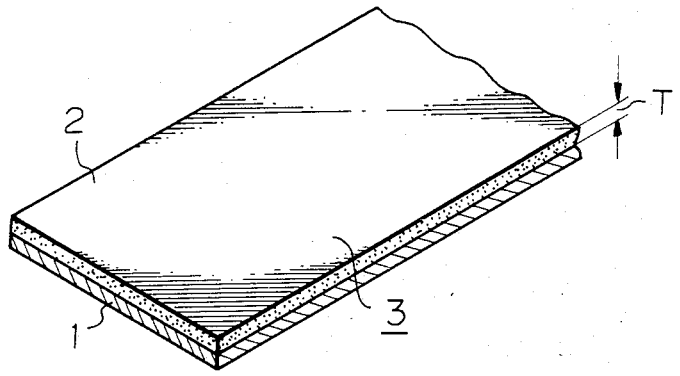
FIG. 1 is a perspective view of a composite ferrite sheet for producing the present composite ferrite textile.
Figure 2:
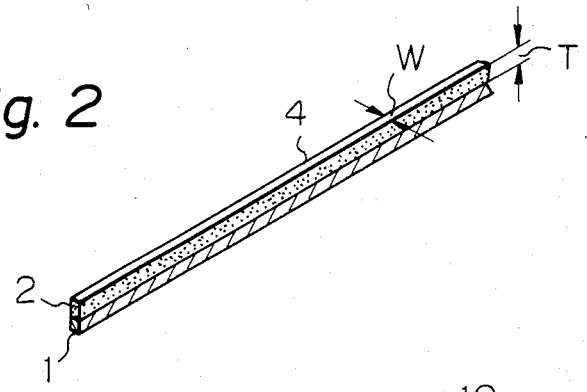
FIG. 2 is a perspective view of the present composite ferrite textile.
Figure 3:
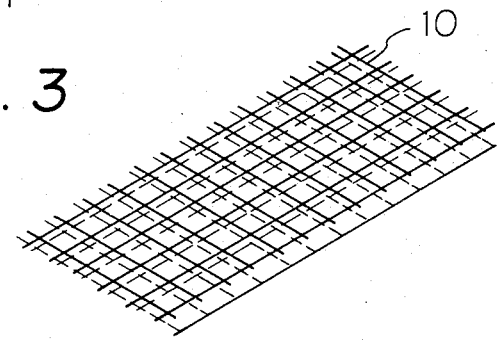
FIG. 3 is a perspective view of a composite ferrite cloth weaved with composite ferrite textile.

The first embodiment is described in accordance with FIGS. 1 through 3. In FIG. 1, the reference numeral 1 is a plastics film substrate which is for instance polyester with the thickness less than 50 microns, 2 is a composite ferrite layer deposited or painted on the film 1 and 3 is the composite ferrite sheet with the substrate 1 and the ferrite layer 2. The composite ferrite layer 2 is first in liquid status with a high molecular compound and ferrite powder with the average diameter 0.3–20 microns. It is supposed that the volume ratio of the ferrite powder to the composite material is in the range between 0.2 and 0.8, and it is also supposed that the high molecular compound has the adhesive property in order to bind the ferrite powder. If the volume ratio of the ferrite powder is less than 0.2, the magnetic nature of the textile is not enough, and if the volume ratio is higher than 0.8, the mechanical property of the textile is not satisfactory, for instance, the textile would be too weak with high ratio of ferrite powder. The thickness t of the composite ferrite layer 2 is less than 1000 microns. Thus, the composite ferrite sheet 3 is obtained.

Next, that composite ferrite sheet 3 is cut or sliced to be an elongated thin ribbon as shown in FIG. 2 so that the width W of each ribbon is less than 1000 microns. Thus, an elongated thin composite ferrite textile 4 is obtained.

The textile 4 is woven into cloth 10 as shown in FIG. 3. In a practical use, a plurality of cloths 10 are laminated.

The composite ferrite cloth thus obtained has the excellent magnetic characteristics, since it contains a sufficient amount of ferrite material. Also, it is flexible enough to fit with any desired shape, light in weight, and strong enough, as it is manufactured as a textile. Therefore, a complicated shape of magnetic material is obtained by using that composite ferrite cloth. The composite ferrite cloth has the advantage that the magnetic property is uniform, because of the uniform weaving.

The present composite textile may be mixed spinning with nylon textile, acrylic textile, or polyester textile. In that case, the cloth is stronger than the composite textile itself because of the strong property of synthetic textile.

When a plurality of cloths 10 are laminated with adhesive means, said adhesive means includes preferably ferrite powder for improving the magnetic characteristics of the laminated cloths.

Some of the industrial fields of the use of the present composite ferrite cloth are; electromagnetic absorbing sheet, electromagnetic wall in a building, an adjustable inductance sheet or ring for color compensation of a deflection yoke of a color braun tube, electromagnetic wave shielding material, a transformer core, a permanent magnet, and a gasket for a microwave oven.

Figure 4:
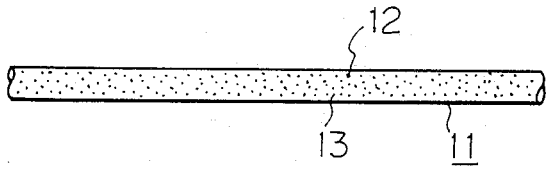
FIG. 4 is another embodiment of the present composite ferrite textile.

FIG. 4 shows another embodiment of the present composite ferrite textile, in which the reference numeral 11 is the composite ferrite textile, 12 is a ferrite powder with the diameter 5–10 microns, and 13 is the high molecular compound like plastics. The volume ratio of the ferrite powder to the composite ferrite textile is in the range between 0.2 and 0.8 as is the case of the previous embodiment. When ferrite powder is Ni-Zn group ferrite or Mn-Zn group ferrite, a composite ferrite textile with high permiability is obtained, and when ferrite powder is Ba (Barium) group ferrite, a composite ferrite textile with high coercive force is obtained. The textile of FIG. 4 is mixed spinning and/or weaved to a cloth as is the previous embodiment, and has the similar effect and the similar application fields to those of the previous embodiment. The ferrite powder may also be Sr group ferrite, or any ferrite with chemical formula $MoFe_2O_3$ where M is metal of bi-valence selected from Ni, Zn, Mn, Cu, Mg and Sr.

Figure 5:
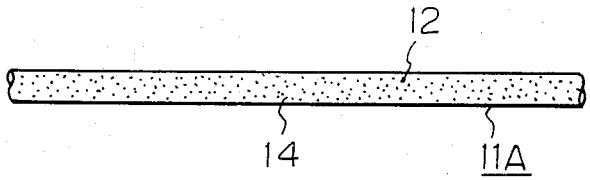
FIG. 5 is modification of the embodiment of FIG. 4.

FIG. 5 is the modification of the embodiment of FIG. 4. In FIG. 5, the reference numeral 11A is the composite ferrite textile, 12 is the ferrite powder, and 14 is glass with low melting point (for instance with the melting point of 500° C.). The ferrite powder 12 is mixed with the melted glass so that the volume ratio of the ferrite powder to the composite ferrite textile is in the range between 0.2 and 0.8. The embodiment of FIG. 5 has the feature that the binder 14 is inorganic material and incombustible. Of course, the composite ferrite textile of FIG. 5 is woven into a cloth as is the previous embodiments, and has the similar advantages and the similar application fields to those of the previous embodiments.

Figure 6:
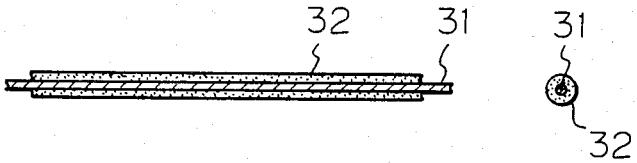
FIG. 6 is still another embodiment of the present composite ferrite textile.

FIG. 6 is another embodiment of the present composite ferrite textile, in which the reference numeral 31 is conventional textile with a high molecular compound like plastics, or conductive textile, and 32 is the composite ferrite powder and high molecule compound covering the center textile 31. The thickness of the cover 32 is in the range between 5 microns and 50 microns, and the volume ratio of ferrite powder to the composite ferrite cover 32 is in the range between 0.2 and 0.8. When the textile 31 is conductive, said textile 31 may be a carbon textile or textile with acrylic textile diffused with copper ion. When the textile 31 is non-conductive, that textile may be silicon carbide, glass textile, plastics like nylon, or alumina textile.

Figure 7:
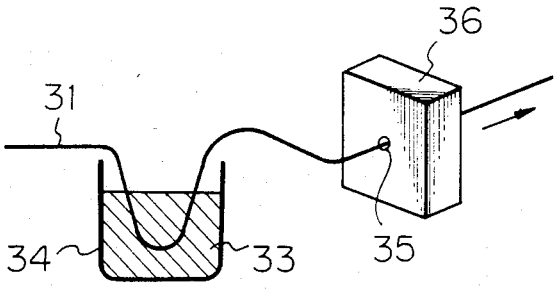
FIG. 7 shows the producing process of the textile of FIG. 6.

FIG. 7 shows the manufacturing process of the textile of FIG. 6. In FIG. 7, the composite ferrite in the liquid status is contained in the basin 34. The textile 31 is dipped into the composite ferrite liquid, then, the textile 31 is pulled up, and then passes through the hole 35 with the predetermined diameter on the die 36. Then, the composite textile is dried. The process of FIG. 7 is repeated a plurality of times so that the cover 32 has the desired thickness.

Figure 8:
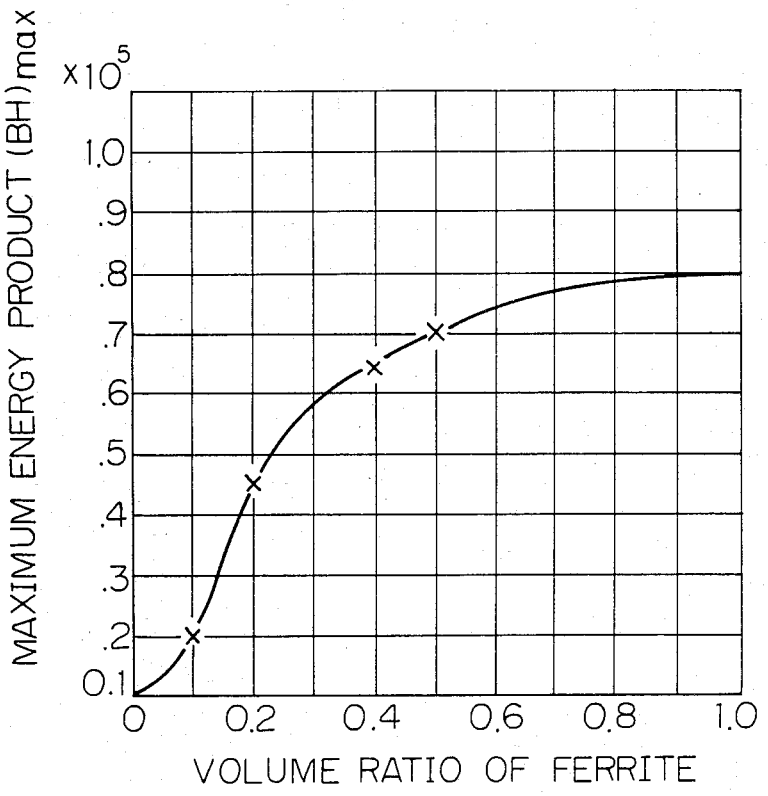
FIG. 8 shows curves between the volume ratio of the ferrite powder to the ferrite textile and the energy product.

FIG. 8 shows the experimental curve between the volume ratio of the ferrite powder to the composite textile and the maximum energy product (BH) which is the product of the coercive force $H_c$ and the saturation flux density $B_r$. The test sample in FIG. 8 is the barium (Ba) ferrite with the average diameter 1.5 micron distributed in natural rubber. Said maximum energy product may evaluate the magnetic property of ferromagnetic material. As is apparent in FIG. 8, the maximum energy product decreases suddenly when the volume ratio is less than 0.2. In FIG. 8, the product of pure ferrite (ratio is 1.0) is $0.8\times10^5$, and the ratio in which the product decreases to 50% ($=0.4\times10^5$) is about 0.17. Accordingly, when the ratio is higher than 0.2, the maximum energy product higher than 50% of that of pure ferrite is obtained. That is the reason why the present invention uses the composite ferrite textile with the volume ratio of ferrite powder higher than 0.2. On the other hand, when that volume ratio is higher than 0.8, the composite ferrite material is too weak, and does not have enough flexibility. Accordingly, the volume ratio is selected between 0.2 and 0.8 in the present invention.

Figure 9:
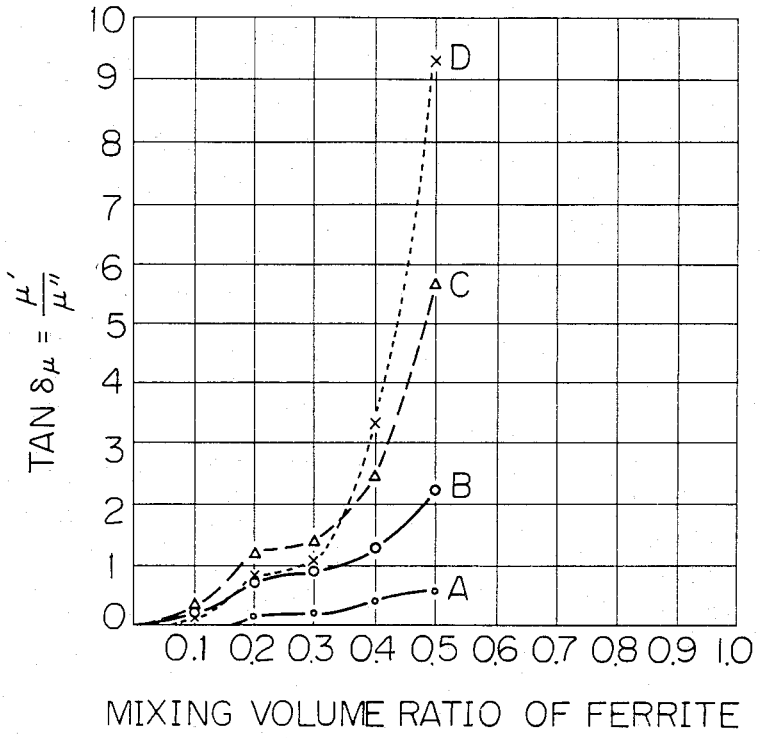
FIG. 9 shows the curves between the mixing volume ratio of ferrite powder and the electromagnetic energy attenuation.

The present ferrite textile may be used as an electromagnetic wave absorber, and the characteristics as the absorber is shown in FIG. 9.

FIG. 9 shows the experimental curves between the mixing volume ratio of the ferrite power to the ferrite mixture, and the loss (tan $(\delta_\mu)=\mu''/\mu'$), in which the curve A shows the data of the average diameter of ferrite powder is 3 micron and the frequency is 2450 MHz, the curve B shows that the data of the average diameter of the ferrite powder is 2 microns and the frequency is 100 MHz, the curve C shows the data of the average diameter of the ferrite powder is 2 microns and the frequency is 500 MHz, and the curve D shows the data of the average diameter of the ferrite powder is 2 microns and the frequency is 1000 MHz. The sample ferrite is Ni-Zn group ferrite, which is mixed with silicon rubber. As is apparent from the curves of FIG. 6, when the mixing volume ratio is less than 0.2, the loss is not sufficient. Therefore, the mixing volume ratio of the ferrite powder to the mixture is selected higher than 0.2 in the present invention. On the other hand, when that ratio is higher than 0.8, the mixture is too hard to fit into desired shape. Therefore, the ratio is selected between 0.2 and 0.8.

From the foregoing it will now be apparent that a new and improved composite ferrite textile has been found. It should be understood of course that the embodiments disclosed are merely illustrative and are not intended to limit the scope of the invention. Reference should be made to the appended claims, therefore, rather than the specification as indicating the scope of the invention.

What is claimed is:

1. A composite ferrite cloth woven from textile, said textile including a composite ferrite textile containing composite ferrite, said composite ferrite comprising a mixture of a ferrite powder and a binder, said binder bonding said ferrite powder together to form said composite ferrite, wherein the volume ratio of ferrite powder to said mixture in said composite ferrite is in the range between 0.2 and 0.8.

2. A composite ferrite cloth according to claim 1, wherein average diameter of said ferrite powder is in the range between 0.3 micron and 20 microns.

3. A composite ferrite cloth according to claim 1, wherein said binder is high molecular compound.

4. A composite ferrite cloth according to claim 1, wherein said binder is glass.

5. A composite ferrite cloth according to claim 1, wherein said composite ferrite textile comprises an elongated thin textile core surrounded by a layer of said composite ferrite covering said textile core.

6. A composite ferrite cloth according to claim 1, wherein said composite ferrite textile comprises a plastic substrate, and composite ferrite deposited on said substrate.

7. A composite ferrite cloth according to claim 1, wherein said composite ferrite textile is a mixed spinning of synthetic textile and composite ferrite textile.

8. A composite ferrite cloth according to claim 1, wherein said composite ferrite powder has chemical formula $MO.Fe_2O_3$, where M is metal of bi-valence selected from Ni, Zn, Mn, Gu, Mg and Sr.

9. A composite ferrite cloth according to claim 8, wherein said composite ferrite powder is Ba group ferrite powder or Sr group ferrite powder.

10. A composite ferrite textile containing composite ferrite, said composite ferrite comprising a mixture of ferrite powder and a binder, said binder bonding said ferrite powder together to form said ferrite composite, wherein the volume ratio of ferrite powder to said mixture is in the range between 0.2 and 0.8.

11. A composite ferrite textile according to claim 10, wherein the average diameter of said ferrite powder is in the range between 0.3 micron and 20 microns.

12. A composite ferrite textile according to claim 10, wherein said binder is high molecular compound.

13. A composite ferrite textile according to claim 10, wherein said binder is glass.

14. A composite ferrite textile according to claim 10, which comprises an elongated thin textile core surrounded by a layer of said composite ferrite covering said textile core.

15. A composite ferrite textile according to claim 10, which comprises a plastic substrate, an composite ferrite deposited on said substrate.

16. A composite ferrite textile according to claim 10, which is a mixed spinning of synthetic textile and composite ferrite textile.

17. A composite ferrite textile according to claim 10 wherein said composite ferrite powder has chemical formula $MO.Fe_2O_3$, where M is metal of bi-valence selected from Ni, Zn, Mn, Cu, Mg and Sr.

18. A composite ferrite textile according to claim 17 wherein said composite ferrite powder is Ba group ferrite powder or Sr group ferrite powder.

19. Process for producing composite ferrite textile according to claim 10, comprising the steps of depositing a layer of ferrite powder bonded by a high molecular compound to form a composite ferrite on a plastic film to form a composite ferrite sheet and, slicing said composite ferrite sheet into elongated thin ribbons to form said composite ferrite textile.

20. Process for producing composite ferrite textile according to claim 10, comprising the steps of providing a composite ferrite liquid in a basin, said liquid comprising a mixture of ferrite powder and binder, dipping a textile into said composite ferrite liquid and pulling up the textile so that the textile is covered with a layer of composite ferrite liquid, passing said textile covered with said layer of composite ferrite liquid through a hole with a predetermined diameter repetitively until a desired thickness of said layer is obtained, and drying the textile covered with said layer of composite ferrite to form said composite ferrite textile.

* * * * *